United States Patent [19]

Asada et al.

[11] 4,293,839

[45] Oct. 6, 1981

[54] THICK FILM RESISTOR

[75] Inventors: Eiichi Asada, Tokyo; Toshio Inokuma, Fujisawa; Isao Egawa, Tachikawa, all of Japan

[73] Assignee: Shoei Chemical Incorporated, Tokyo, Japan

[21] Appl. No.: 129,784

[22] Filed: Mar. 12, 1980

[30] Foreign Application Priority Data

Mar. 13, 1979 [JP] Japan ..... 54-29081

[51] Int. Cl.[3] ..... H01C 1/012

[52] U.S. Cl. ..... 338/309; 252/514; 338/314; 338/334

[58] Field of Search ..... 338/308, 309, 307, 314, 338/334; 252/518, 514; 29/610

[56] References Cited

U.S. PATENT DOCUMENTS

| | | | |
|---|---|---|---|
| 3,352,797 | 11/1967 | Kim | 252/514 |
| 4,016,525 | 4/1977 | Maher et al. | 338/309 |
| 4,076,894 | 2/1978 | Langley et al. | 338/308 X |
| 4,194,108 | 3/1980 | Nakajima et al. | 338/309 X |

*Primary Examiner*—C. L. Albritton

*Attorney, Agent, or Firm*—Blanchard, Flynn, Thiel, Boutell & Tanis

[57] ABSTRACT

A thick film resistor comprising a resistive film element comprising 100 parts by weight of $RuO_2$ and glass and 0.1 to 15 parts by weight of Au, electrodes containing not less than 50 weight percent of Ag therein connected to the terminal portions of the resistive film element, and an insulating substrate on which the resistive film element and the electrodes are formed.

6 Claims, 5 Drawing Figures

THICK FILM RESISTOR

BACKGROUND OF THE INVENTION

The present invention relates to a thick film resistor comprising a resistive film element and electrodes which are partly overlapped on each other and more particularly to a thick film resistor in which the residual resistance and contact noise of the overlapped portion of the resistive film element and the electrode are significantly reduced.

Referring to FIG. 1, there is schematically shown a conventional thick film horseshoe-shaped variable resistor. In the figure, reference numeral 1 represents an insulating substrate, reference numeral 2 terminal electrodes and reference numeral 3 a resistive film element. This type of thick film resistor has the shortcomings that the electric resistance (residual resistance) of the overlapped portions 4,4 of the resistive film element 3 and the electrodes 2,2 is much greater than that of the other portions of the resistive film element and that great contact noise is generated from the overlapped portions 4,4. These shortcoming are particularly marked when electrode 2 is formed by using a conductive material containing much Ag. Usually, in such terminal electrode 2, Ag, Ag-Pd or Ag-Pt electrodes containing a great amount of Ag are most commonly used since they are excellent in solderability and electric conductivity and comparatively low in cost. However, the above-mentioned shortcomings, such as great residual resistance and generation of contact noise are unavoidable.

Therefore, when using this sort of thick film resistor, a movable contact is stopped immediately before the overlapped portion 4 of the electrode 2 and the resistive film element 3. In this method, however, the resistive film element 3 cannot be used to the upper and lower limits of its intrinsic resistance and, consequently, its resistance-adjustable range is reduced, so that it is difficult to utilize its characteristics sufficiently. In particular, it is difficult to minimize its resistance to near zero although it is important for variable resistors to be capable of reducing the resistance to zero as much as possible.

Referring to FIG. 2, there is schematically shown a resistor network comprising multiple resistive film elements 3 having different aspect ratios (i.e. the ratio of the length to the width), which are formed on the insulating substrate 1. In the resistor network, resistance of each resistive film element is found to be deviated greatly from the resistance pre-estimated from its geometrical shape due to the generation of the residual resistance in the overlapped portions of the resistive film elements 3 and the electrodes 2. Furthermore, since its deviation is irregular, the properties of the produced resistor are not uniform. This may bring about much difficulty in performing the circuit design.

BRIEF DESCRIPTION OF THE DRAWINGS

In the figures.

SUMMARY OF THE INVENTION

Figure 1:
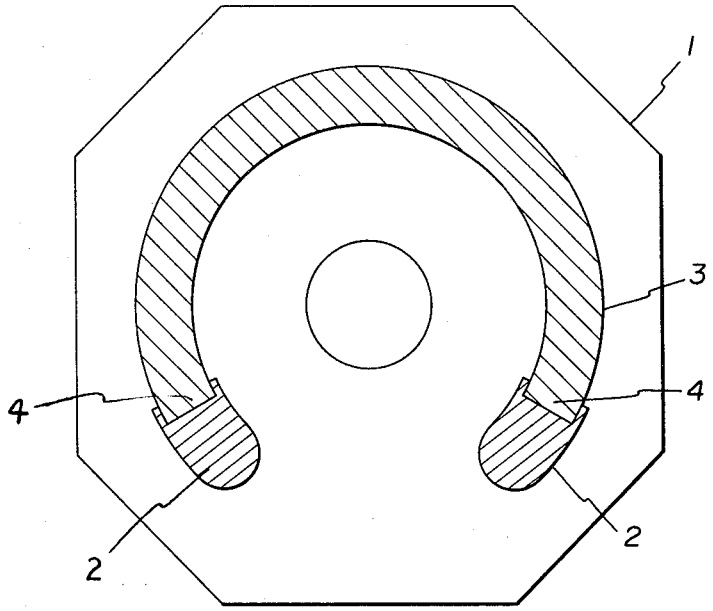
FIG. 1 PRIOR ART
FIG. 1 shows schematically a part of a horseshoe-shaped variable resistor to which the present invention is applicable.
Figure 2:
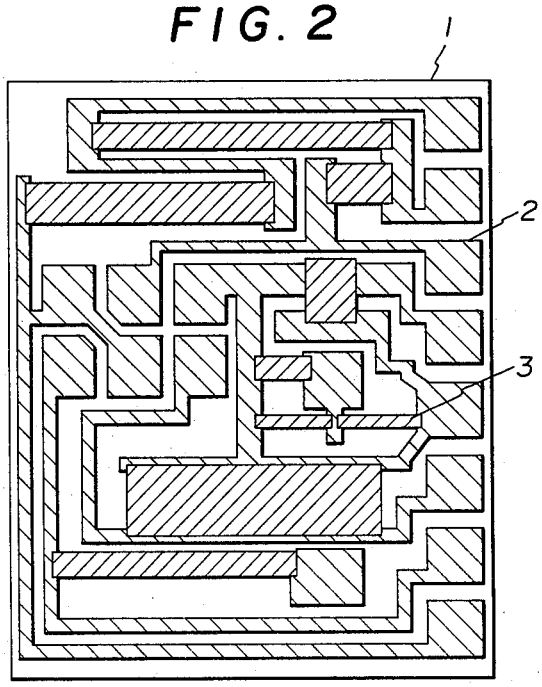
FIG. 2 shows schematically a resistor network comprising multiple resistive film elements formed on an insulating substrate to which the present invention is applicable.

It is therefore an object of the present invention to provide a thick film resistor with reduced residual resistance and contact noise.

The thick film resistor according to the present invention comprises a resistive film element comprising 100 parts by weight of $RuO_2$ and glass and 0.1 to 15 parts by weight of Au, and electrodes containing not less than 50 weight percent of Ag, which are formed in the terminal portions of the resistive film, and an insulating substrate on which the resistive film element and the electrodes are formed.

According to the present invention, the residual resistance of the portions where the resistive film and the electrodes are overlapped is significantly reduced and the deviation of the resistance throughout the whole range of the resistive film element is reduced. Furthermore, generation of contact noise is also reduced.

DETAILED DESCRIPTION OF THE PREFERRED EMBODIMENTS

In a thick film resistor according to the present invention, a resistive film element comprising 100 parts by weight of $RuO_2$ and glass and 0.1 to 15 parts by weight of Au, and electrodes containing not less than 50 weight percent of Ag which are formed in the terminal portions of the resistive film are formed on an insulating substrate.

The combination of the resistive film element and the electrodes containing not less than 50 weight percent of Ag reduces the residual resistance of their overlapped portions significantly and, consequently, the deviation of the resistance of the film resistor is also reduced. Furthermore, the contact noise of the resistor can also be reduced significantly. The reason for this has not yet been clarified. However, one difference between a conventional thick film resistor and the thick film resistor according to the present invention is that, in the conventional resistor, there is a clear metallurgical distinction in composition between the conventional resistive film element consisting of $RuO_2$ and glass and the electrodes containing not less than 50 weight percent of Ag, while in the present invention, there is not such a clear distinction in composition, and, in the overlapped portion of the resistive film element and the electrode, the composition changes continuously. To be more specific, the observation and analysis of the cross section of the overlapped portions of the resistive film element and the electrodes according to the present invention by use of a scanning electron microscope and an X-ray micro analyzer showed that Ag migrates from the electrodes to the resistive film element and metallic islands and branches of Au-Ag are formed. From this result, it is considered that Ag that has migrated from the electrodes combines with Au to form a Ag-Au alloy, hindering formation of a $RuO_2$-Ag alloy having a great specific resistivity which may cause the previously mentioned shortcomings of the conventional thick film resistor. Furthermore, the formation of the islands of Au-Ag alloy may reduce the distance of the conductive path in the resistive film. It is considered that the above-mentioned phenomenon will contribute to the reduction of residual resistance and contact noise.

When more than 15 parts by weight of Au per 100 parts by weight of $RuO_2$ and glass are added to the resistive film element, the resistance near the overlapped portion of the resistive film element and the electrode is excessively reduced compared with the resistance of the other portion of the resistive film element. This is not desirable. On the other hand, when the amount of Au to be added to the resistive film element is less than 0.1 parts by weight, the effect of the present invention is not obtained satisfactorily. Therefore, according to the present invention, the amount of Au to be added to the resistive film element has to be in the range of 0.1 to 15 parts by weight per 100 parts by weight of $RuO_2$ and glass and more preferably it should be in the range of 0.2 to 12 parts by weight.

The ratio of $RuO_2$ to glass in the resistive film element can be determined, depending upon the desired resistance of the resistor element.

In the resistive film element according to the present invention, conventional glass, such as a borosilicate glass can be used.

The amount of Au to be added to the resistive film element also varies depending upon the desired resistance of the resistor, namely, depending upon the ratio of $RuO_2$ to glass in the resistive film and when the amount of $RuO_2$ is increased, a small amount of Au will do. However, when the amount of $RuO_2$ is decreased, it is preferable to increase the amount of Au.

In the present invention, by use of the resistive film having the above-mentioned specific compositions, the shortcomings of the conventional thick film resistor element are eliminated, without impairing the performance of the electrodes and also without changing the process of preparing the thick resistor.

In particular, when the ratio of $RuO_2$ based on total amount of $RuO_2$ and glass is in the range of 50 to 3 wt.% and the desired resistance (resistivity) is in the range of 0.1 kΩ/square to 10 MΩ/square, the present invention is most effective.

In the above-mentioned electrode, if necessary, Pd and/or Pt can be also used together with Ag as a conductive material.

The present invention will now be explained more specifically by showing the following examples:

Residual Resistance Near the Overlapped Portion of Resistive Film and Electrode

EXAMPLE 1

An electrode including 65 wt.% of Ag and 35 wt.% of Pd as a conductive material was formed on an alumina substrate. Using this electrode as a terminal, resistive films comprising the following components were prepared and each of the resistive films is formed in the form of horseshoe as shown in FIG. 1.

| | |
|---|---|
| $RuO_2$ | 20 Parts by Weight |
| Lead Borosilicate Glass | 80 Parts by Weight |
| Au | 0, 0.3 and 3.0 Parts by Weight |

Figure 3:
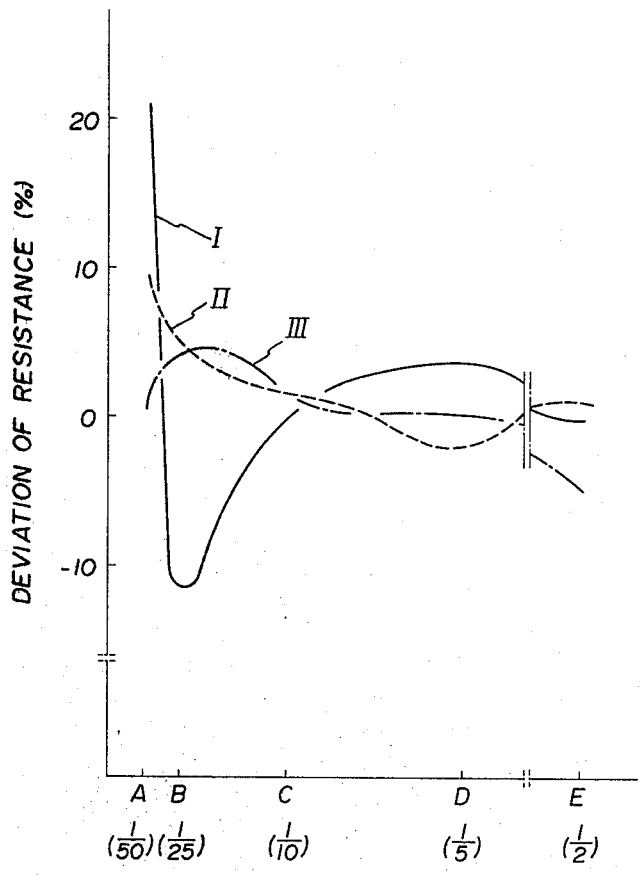
FIG. 3 shows the deviation of the resistance at predetermined different measurement points of a resistive film element of Example 1 according to the present invention.

Supposing that the entire length of the resistive film element is 1, the resistance of each of five points A, B, C, D and E, which are respectively located at 1/50, 1/25, 1/10, 1/5 and ½ from one terminal, was measured and the deviation of the resistance at each measurement point from the average resistance calculated on the basis of the total resistance of each resistive film element was obtained. Table 1 and FIG. 3 show the results. In FIG. 3, curve I indicates the result when no Au was added and curve II the result when 0.3 part by weight of Au was added and curve III the result when 3 parts by weight of Au were added.

TABLE 1

| | Au Parts by Weight | | |
|---|---|---|---|
| Measurement Point | 0 | 0.3 | 3 |
| A (1/50) | +20.7% | +9.5% | +0.4% |
| B (1/25) | −11.0 | +4.3 | +4.2 |
| C (1/10) | +0.7 | +1.5 | +1.8 |
| D (1/5) | +3.5 | −2.4 | +0.1 |
| E (1/2) | −0.5 | +0.8 | −4.8 |

As can be seen from Table 1 and FIG. 3, by the addition of Au to the resistive film, the deviation of the resistance near the overlapped portion of the resistive film and the electrode tends to be decreased and in this example, good results were obtained when about 0.3 part by weight of Au or more Au was added.

EXAMPLE 2

An electrode including 95 wt.% of Ag and 5 wt.% of Pd as a conductive material was formed on the alumina substrate. Using this electrode as a terminal, resistive films comprising the following components were prepared in the shape of horseshoe:

| | |
|---|---|
| $RuO_2$ | 20 Parts by Weight |
| Lead Borosilicate Glass | 80 Parts by Weight |
| Au | 0, 8 and 12 Parts by Weight |

Figure 4:
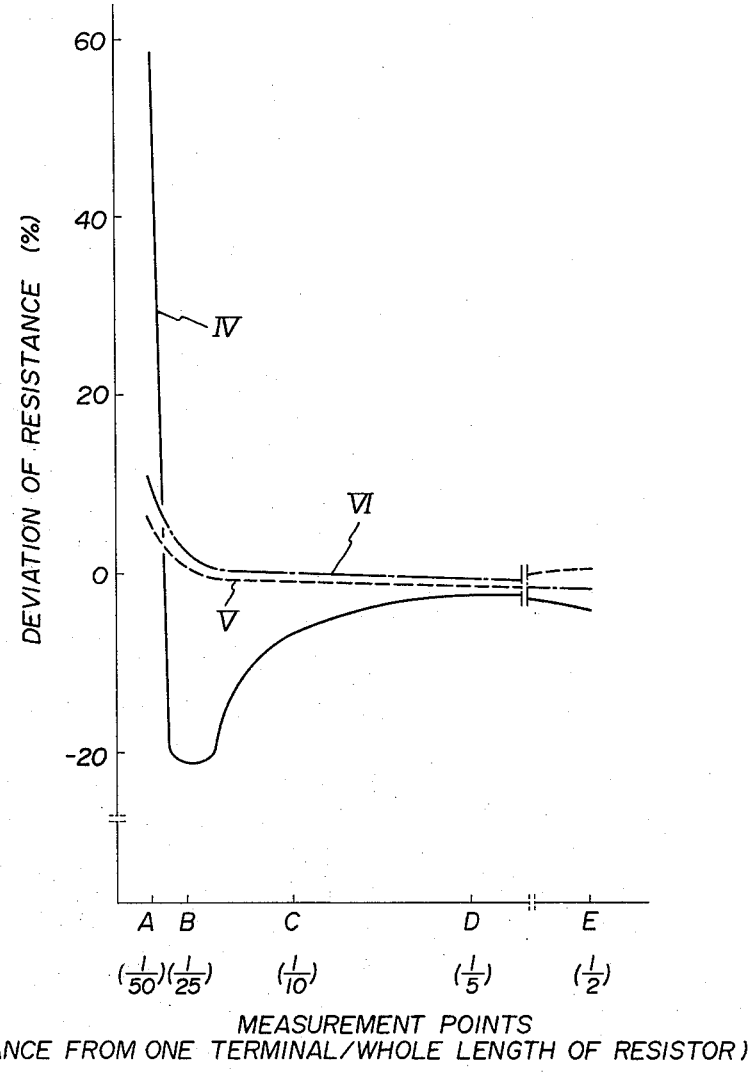
FIG. 4 shows the deviation of the resistance at predetermined different measurement points of a resistive film element of Example 2 according to the present invention.

As in the case of Example 1, the deviation of the resistance at each measurement point was obtained. Table 2 and FIG. 4 show the results. In FIG. 4, curve IV indicates the result when no Au was added and curve V the result when 8 parts by weight of Au were added and curve VI the result when 12 parts by weight of Au were added.

TABLE 2

| | Au Parts by Weight | | |
|---|---|---|---|
| Measurement Point | 0 | 8 | 12 |
| A (1/50) | +57.8% | +10.5% | +5.6% |
| B (1/25) | −21.1 | +2.3 | +0.3 |
| C (1/10) | −5.7 | +0.3 | −0.8 |
| D (1/5) | −2.6 | −0.7 | −2.4 |
| E (1/2) | −4.3 | −1.5 | +0.7 |

EXAMPLE 3

An electrode including 97 wt.% of Ag and 3 wt.% of Pt as a conductive material was formed on the alumina substrate. Using this electrode as a terminal, resistive films comprising the following components were prepared in the shape of horseshoe:

| | |
|---|---|
| $RuO_2$ | 20 Parts by Weight |
| Lead Borosilicate Glass | 80 Parts by Weight |

-continued

| | |
|---|---|
| Au | 0, 12 and 15 Parts by Weight |

As in the case of Example 1, the deviation of the resistance at each measurement point was obtained. Table 3 and FIG. 5 show the results.

TABLE 3

| Measurement Point | Au Parts by Weight 0 | 12 | 15 |
|---|---|---|---|
| A (1/50) | +79.8% | +10.3% | −5.4% |
| B (1/25) | −20.5 | −4.1 | −2.9 |
| C (1/10) | −4.5 | −3.8 | −1.0 |
| D (1/5) | −0.3 | −1.9 | +0.3 |
| E (1/2) | −4.9 | −0.7 | −1.4 |

Figure 5:
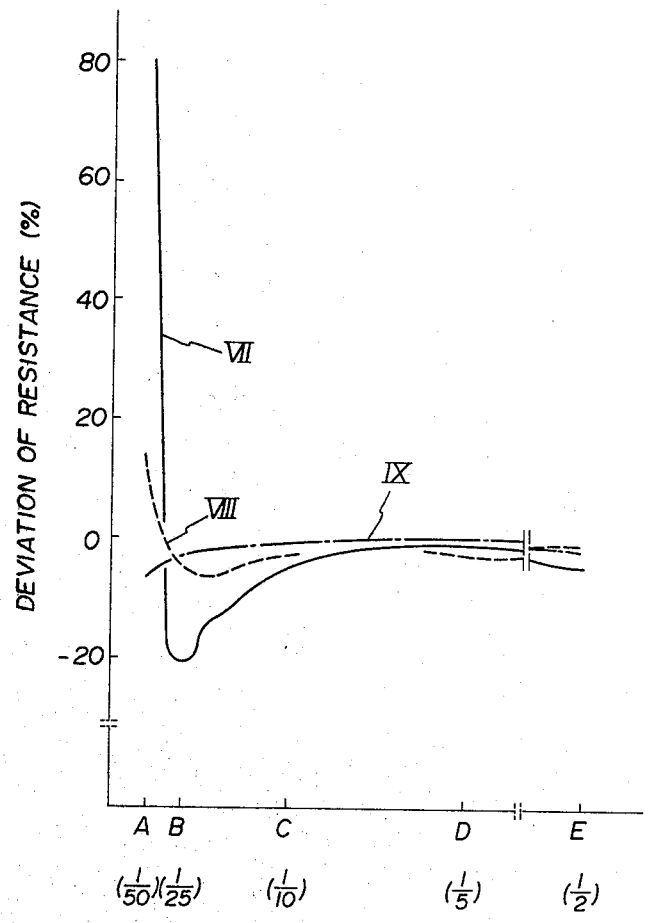
FIG. 5 shows the deviation of the resistance at predetermined different measurement points of a resistive film element of Example 3 according to the present invention.

In FIG. 5, curve VII indicates the result when no Au was added and curve VIII the result when 12 parts by weight of Au were added and curve IX the result when 15 parts by weight of Au were added.

Geometric Effect

EXAMPLE 4

An electrode including of Ag 70 wt.% and Pd 30 wt.% as a conductive material was formed on the alumina substrate. Using this electrode as a terminal, resistive films comprising the following components were prepared in the patterns of 1 mm wide×1 mm long and 1 mm wide×8 mm long:

| | |
|---|---|
| $RuO_2$ | 5 Parts by Weight |
| Lead Borosilicate Glass | 95 Parts by Weight |
| Au | 0, 0.3, 3, 12 and 20 Parts by Weight |

Supposing that the resistances of the resistive films of the respective sizes are $R_1$ and $R_8$, the variation of the resistance by the change of size, namely, the geometric effect was presented in the form of $R_1/R_8 \times 100$. Table 4 shows the geometric effect and the values of $R_8$ and TCR.

TABLE 4

| Added Amount of Au (Parts by Weight) | Geometric Effect $R_1/R_8 \times 100$ | $R_8$ (Ω/Square) | TCR (ppm/°C.) |
|---|---|---|---|
| 0 | 200 | 1.0 M | −125 |
| 0.3 | 135 | 0.95M | −119 |
| 3 | 120 | 0.85M | −117 |
| 12 | 90 | 0.70M | −105 |
| 20 | 50 | 0.55M | −97 |

As can be seen from Table 4, the ratio of $R_1$ to $R_8$ is great at Au equals 0. However, this ratio is decreased as the added amount of Au is increased and particularly in the range of 3 to 12 parts by weight of Au, the ratio becomes extremely small and the variation of the resistance caused by the change in size of the resistance element becomes extremely small. When excess Au was added, the ratio of $R_1$ to $R_8$ becomes too small and the absolute resistance itself is reduced. This is not desirable.

EXAMPLE 5

The geometric effect was further investigated under the same condition of Example 4, except that the resistive films comprising the following components were employed:

| | |
|---|---|
| $RuO_2$ | 7 Parts by Weight |
| Lead Borosilicate Glass | 93 Parts by Weight |
| Au | 0, 0.5, 3, 12 and 20 Parts by Weight |

Table 5 shows the results of the investigation.

TABLE 5

| Added Amount of Au (Parts by Weight) | Geometric Effect $R_1/R_8 \times 100$ | $R_8$ (Ω/Square) | TCR (ppm/°C.) |
|---|---|---|---|
| 0 | 170 | 100k | −230 |
| 0.5 | 140 | 98k | −225 |
| 3 | 110 | 90k | −210 |
| 12 | 80 | 82k | −200 |
| 20 | 50 | 35k | −195 |

EXAMPLE 6

The geometric effect was further investigated under the same condition of Example 4, except that the resistive films comprising the following components were employed:

| | |
|---|---|
| $RuO_2$ | 30 Parts by Weight |
| Lead Borosilicate Glass | 70 Parts by Weight |
| Au | 0, 0.3, 3 and 12 Parts by Weight |

Table 6 shows the results.

TABLE 6

| Added Amount of Au (Parts by Weight) | Geometric Effect $R_1/R_8 \times 100$ | $R_8$ (Ω/Square) | TCR (ppm/°C.) |
|---|---|---|---|
| 0 | 150 | 1.1 k | −70 |
| 0.3 | 115 | 0.97k | −70 |
| 3 | 105 | 0.90k | −60 |
| 12 | 80 | 0.78k | −55 |

EXAMPLE 7

The geometric effect was still further investigated under the same condition of Example 4, except that the resistive films comprising the following components were employed:

| | |
|---|---|
| $RuO_2$ | 50 Parts by Weight |
| Lead Borosilicate Glass | 50 Parts by Weight |
| Au | 0, 0.2, 0.4 and 3 Parts by Weight |

Table 7 shows the results.

TABLE 7

| Added Amount of Au (Parts by Weight) | Geometric Effect $R_1/R_8 \times 100$ | $R_8$ (Ω/Square) | TCR (ppm/°C.) |
|---|---|---|---|
| 0 | 120 | 105 | +130 |
| 0.2 | 110 | 108 | +130 |
| 0.4 | 90 | 120 | +120 |
| 3 | 60 | 135 | +115 |

Contact Noise

EXAMPLE 8

An electrode consisting of Ag 70 wt.% and Pd 30 wt.% as a conductive component was formed on the alumina substrate. Using this electrode as a terminal, a resistive film of 100 kΩ/square comprising the following components was prepared in the shape of a horseshoe:

| | |
|---|---|
| $RuO_2$ | 15 Parts by Weight |
| Lead Borosilicate Glass | 85 Parts by Weight |

To the resistive film was attached a movable contact made of Ag plated phosphorous bronze so that a variable resistor was prepared and the contact noise of this variable resistor was measured. The result showed that the start hop-off noise, namely the contact noise at the interface portion between the resistive film and the overlapped portion of the resistive film and the electrode was 11%. This far exceeded its permissible limit (3%) so that the variable resistor was found not to be useful in practice.

Instead of the above-mentioned resistive film, a resistive film comprising the following components was prepared and, using the resistive film under the above-mentioned condition, its contact noise was measured. As a result, the start hop-off was significantly improved to 1.5%.

| | |
|---|---|
| $RuO_2$ | 15 Parts by Weight |
| Lead Borosilicate Glass | 85 Parts by Weight |
| Au | 2 Parts by Weight |

What is claimed is:

1. A thick film resistor, comprising: an electrically insulating substrate; a resistive film element on said substrate, said resistive film element consisting essentially of (A) 100 parts by weight of $RuO_2$ and glass, and (B) 0.1 to 15 parts by weight of Au, wherein the ratio of $RuO_2$ to glass is effective to provide the desired resistance of said thick film resistor; and electrodes on said substrate and overlapped with the terminal portions of said resistive film element, said electrodes containing not less than 50 weight percent of Ag.

2. A thick film resistor as claimed in claim 1, wherein said glass of said resistive film element is borosilicate glass.

3. A thick film resistor as claimed in claim 1 in which component (A) contains from 3 to 50 weight percent of $RuO_2$ and the balance is essentially glass.

4. A thick film resistor as claimed in claim 1 in which said resistive film element consists of component (A) and component (B).

5. A thick film resistor as claimed in claim 1 in which said resistive film element contains from 0.2 to 12 parts by weight of Au.

6. A thick film resistor as claimed in claim 1 in which the Ag in said electrodes has migrated into said terminal portions of said resistive film element and has formed an Ag-Au alloy.

* * * * *